United States Patent [19]

Lans et al.

[11] 4,153,111

[45] May 8, 1979

[54] WELL HEAD RETRIEVER TOOL AND METHOD

[75] Inventors: Kenneth I. T. Lans; Desmond E. Ross, both of Pointe-a-Pierre, Trinidad and Tobago

[73] Assignee: Texaco Trinidad, Inc., Pointe-a-Pierre, Trinidad and Tobago

[21] Appl. No.: 835,928

[22] Filed: Sep. 23, 1977

[51] Int. Cl.[2] ..... E21B 33/03

[52] U.S. Cl. ..... 166/315; 166/85

[58] Field of Search ..... 166/315, 153, 156, 75, 166/85, 86

[56] References Cited

U.S. PATENT DOCUMENTS

| | | | |
|---|---|---|---|
| 2,148,327 | 2/1939 | Smith et al. | 166/85 |
| 2,180,680 | 11/1939 | Hild | 166/77 |
| 2,241,288 | 5/1941 | Yancey | 166/85 |
| 2,241,333 | 5/1941 | Smith | 166/315 |
| 2,358,677 | 9/1944 | Yancey | 166/85 |
| 3,830,304 | 8/1974 | Cummins | 166/315 |
| 3,924,686 | 12/1975 | Arnold | 166/75R |

*Primary Examiner*—Ernest R. Purser

*Attorney, Agent, or Firm*—Thomas H. Whaley; Carl G. Ries; Henry C. Dearborn

[57] ABSTRACT

A tool and accessories for use in a method of removing a shooting valve, or blow-out preventer from a well having pressure therein, without killing the well. The tool has a mandrel with a well head plug on one end that matches a casing head fixture. The mandrel is long enough to extend through the shooting valve, or blow-out preventer when the plug is in place in the casing head fixture. And, there is a pressure tight housing which can receive the mandrel and plug inside the housing. When the housing has been attached to the shooting valve, or blow-out preventer, the pressure in the housing may be equalized with the well pressure, and then the plug can fall into place and be secured there. Thereafter, the housing pressure will be released and the shooting valve, or blow-out preventer can be removed while the well pressure is contained by the plug.

10 Claims, 4 Drawing Figures

WELL HEAD RETRIEVER TOOL AND METHOD

BACKGROUND OF THE INVENTION

1. Field of the Invention

This invention concerns apparatus and a method of using same, which is applicable to oil wells where well pressure has developed. More specifically, it relates to an apparatus and method for retrieving a shooting valve or the like from a well under pressure, without killing the well.

2. Description of the Prior Art

Heretofore, a U.S. Pat. No. 3,830,304 issued Aug. 20, 1974, has indicated some apparatus and a procedure that could be used to isolate (with a pressure seal) a portion of the internal tubing connections in a well. However, it involved connection to the tubing, which connection had to be maintained in order to contain the pressure within that tubing. Furthermore, such pressure maintenance had to be above the surface valves on the well head. Consequently, what that patent purports to accomplish is the ability to contain the pressure from production tubing by inserting a tool through the well head valves, without the need for removing such valves.

In contrast, the applicants invention provides for the ability to hold the well pressure at the casing head, and then while so containing the well pressure remove any well head valve so that it may be used elsewhere. Thus, it is an object of this invention to provide a relatively simple tool which may be used for removing well head valves or the like, without the need for killing the well first.

SUMMARY OF THE INVENTION

Briefly, the invention concerns a retriever for use on a well having casing pressure and including a well head with valve means mounted thereon to contain said casing pressure. Such retriever combines in combination a mandrel having means for supporting the weight thereof and having a plug for said well head at one end of the mandrel. The said mandrel is long enough to extend through said valve means when said plug is in place at said well head. The retriever also comprises a pressure tight housing having an exit and adapted for receiving said mandrel therein with said plug facing said exit. The said housing also has means for attaching said exit to said valve means on the side opposite to said well head. The retriever also comprises means associated with said housing for cooperating with said mandrel supporting means and for releasing said mandrel when said valve means is opened, whereby said plug will fall into place at said well head. And, it comprises means for securing said plug against said casing pressure, whereby said valve means may be removed without killing said well.

Again briefly, the invention concerns a shooting valve retriever for use in removing a shooting valve or the like from a well head when the well has developed pressure. The said well has a casing fixture with a lateral port therein connecting the interior of said casing with the exterior of said fixture. The retriever comprises in combination an elongated cylindrical member having one end closed and having a flange on the other end adapted for being coupled to said shooting valve, and a mandrel having a piston at one end and a tubing hanger at the other end. The said piston is adapted to make a sealing fit with the inside of said cylindrical member, and said tubing hanger is adapted to match said casing fixture. The retriever also comprises manifold means for connecting said lateral port with said member for applying well pressure to support said mandrel in said member after said member has been coupled to said shooting valve. It also comprises valves means for equalizing said well pressure on both sides of said piston to permit said mandrel to fall through said shooting valve when open and seat said tubing hanger in said casing fixture, and means for fixing said hanger in place to hold said well pressure. The said tubing hanger has plug means for stopping flow of well fluid therethrough.

Once more briefly, the invention concerns a method of removing a shooting valve or blow-out preventer or the like from a well head after the well has developed pressure, said well head having a casing fixture with a lateral port therein connecting the interior of said casing with the exterior of said fixture. The method comprises the steps of assembling a mandrel having a piston at one end and a tubing hanger at the other end with a plug in said hanger. The said mandrel is long enough to extend through said shooting valve when said tubing hanger is seated in said casing fixture. It also comprises the steps of inserting said mandrel piston end first into a cylindrical member having a closed end and a flange at the other end adapted for being coupled to said shooting valve, and coupling said cylindrical member onto said shooting valve with said mandrel inside. It also comprises applying pressure beneath said piston in said cylindrical member to lift said mandrel up enough to clear said shooting valve, and opening said shooting valve. Also it comprises equalizing the pressure on both sides of said piston in order to allow said mandrel to fall until said hanger seats in said casing fixture, and fixing said hanger and plug in place in said casing fixture to contain said well pressure. It also comprises releasing said equalization pressure and said pressure beneath said piston, and uncoupling and removing said shooting valve and cylindrical member together.

Once again, briefly, the invention concerns a method of retrieving a well closure from the well head of a well under pressure without killing said well. It comprises the steps of attaching a pressure tight means containing a well head plug therein on the other side of said closure from said well head, and opening said closure to permit passage of said plug therethrough into seating engagement with said well head. It also comprises securing said plug in place to contain said well pressure whereby said closure may thereafter be removed.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

This invention provides a tool and method of using same, which is applicable to removing shooting valves, or blow-out preventers, or the like from wells which have developed pressure therein, without the necessity of killing the well. It will be appreciated by those skilled in this art that a well which has developed pressure upon "shooting" the subsurface or otherwise has developed natural pressure, may be subject to loss of such pressure if the well is subsequently "killed" to contain its pressure in order to work at the well head for removal of valves or the like. Consequently, many times some wells in a given field are left to produce with a shooting valve, or a blow-out preventer connected at the well head. This means that such valve, or blow-out preventer is tied up and may not be used elsewhere during the pressure life of the well. However, by using a tool and method of use thereof, according to this invention the shooting valves or blow-out preventers may be removed easily and quickly for use elsewhere, without killing the well.

It will be understood by one skilled in this art that the term "shooting" is applied to the procedure of stimulating a formation down hole by detonating an explosive (usually so as to perforate the casing) adjacent to the formation. Also, the term "killing" is used to mean a procedure of introducing a column of fluid in the well which has sufficient density to equalize the pressure at the formation.

Figure 1:
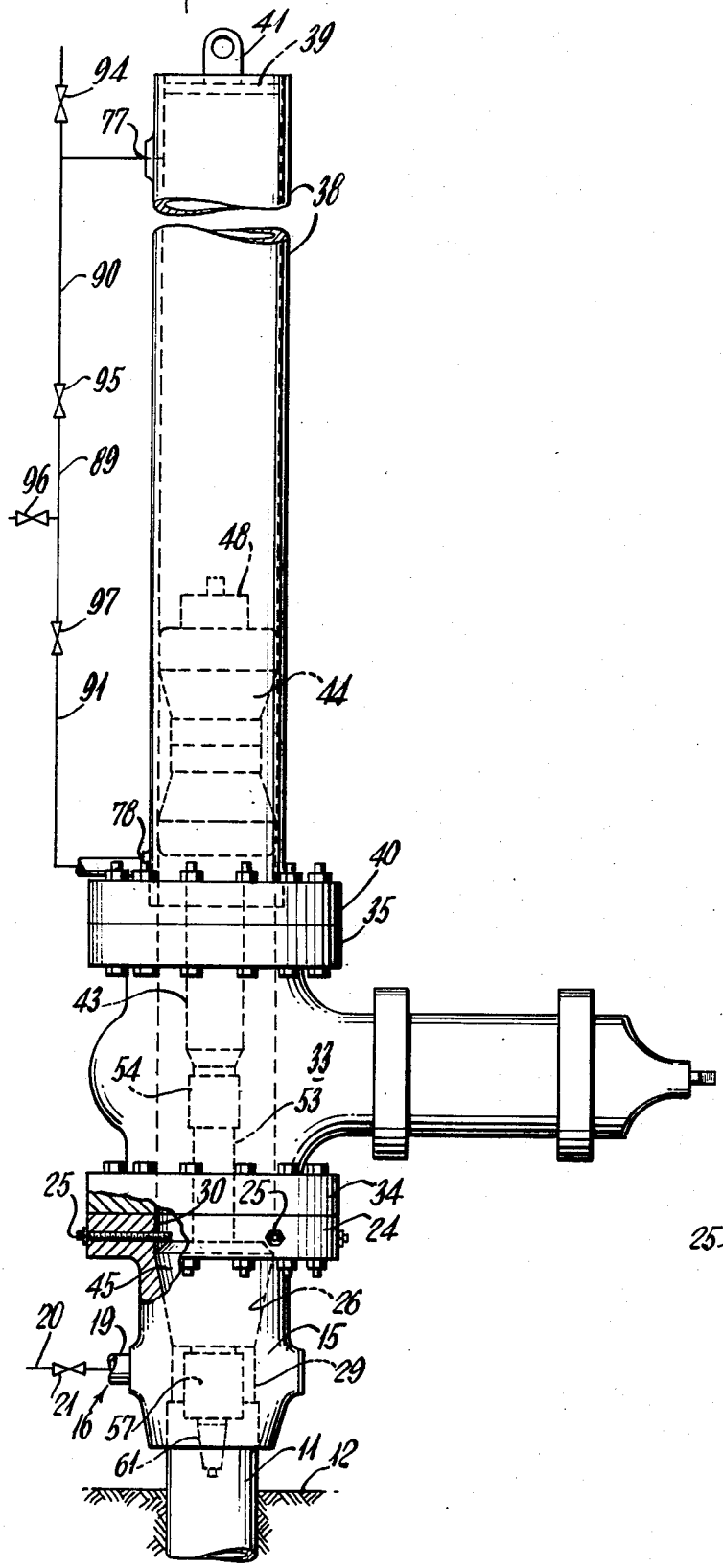
FIG. 1 is a side elevation partly broken away in cross-section which schematically indicates some of the connected elements as well as the surface of the earth near the well head.
Figure 2:
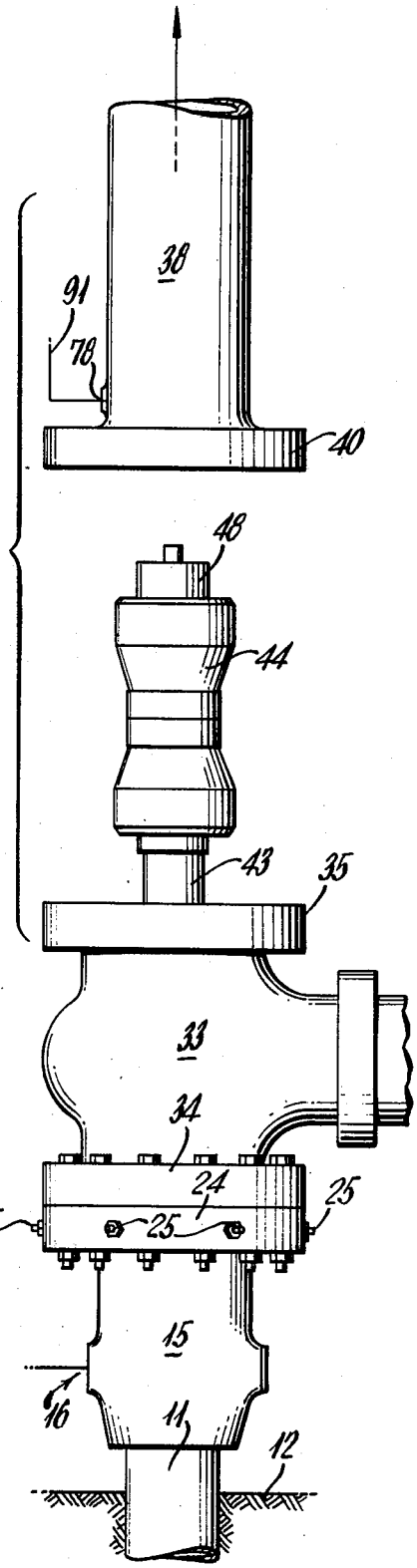
FIG. 2 is another side elevation like FIG. 1 but showing the tool housing member removed from the well head valve, leaving the tool plugging the well head casing as indicated in FIG. 1.

With reference to FIGS. 1 and 2 of the drawings it will be observed that there is illustrated a well head having a casing 11 which extends above the surface of the earth, that is schematically indicated and designated by reference numeral 12. There is attached to the top of the casing 11 a casing fixture 15 that has a lateral port 16 connecting the interior of the fixture 15, and the casing 11 with the exterior of the fixture. It will be observed in FIG. 1 that a pipe 19 may be connected to the port 16 at the exterior of the fixture 15. Also, (as schematically indicated) there may be additional piping 20 including a valve 21 in order to control the well pressure that exists within the well casing 11.

The well head fixture 15 includes a flange 24 which has provision for a plurality of radially extending set screws 25 that are long enough to extend through the flange 24 and into an internal axially located passage way 26 that is tapered from a smaller internal diameter axial portion 29, to a larger diameter straight portion 30 at the top (as viewed in FIG. 1).

The well head fixture 15 has a shooting valve 33 attached to it by bolting a flange 34 to the flange 24 of the fixture 15. The valve 33 also has another flange 35 for making an attachment to the other side of the valve.

Retriever apparatus according to this invention includes an elongated cylindrical member 38 that has a closed end 39 with a bracket 41 welded thereon for handling the member 38. Member 38 also has a flange 40 at the other end, that is adapted for being coupled to the flange 35 of the shooting valve 33. This member 38 acts as a pressure tight housing for a mandrel 43 that is indicated in dashed lines in FIG. 1 and illustrated in greater deal in FIG. 3.

Figure 3:
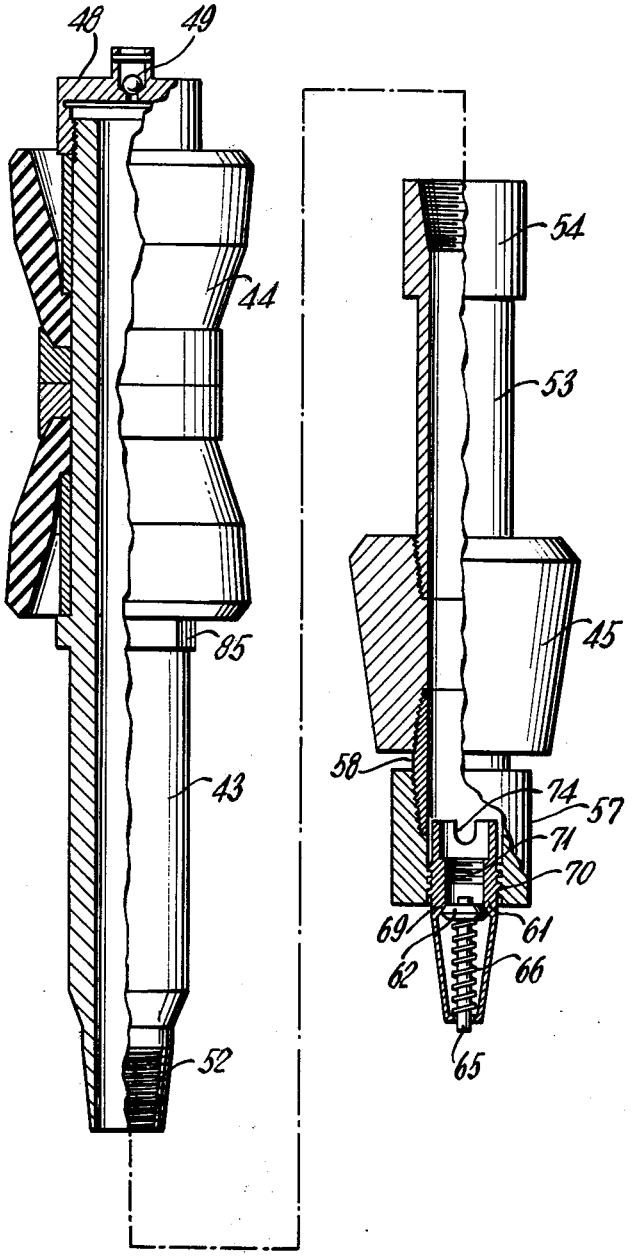
FIG. 3 is a side elevation partly in cross-section showing a tool according to the invention.

As shown in FIG. 3 the mandrel 43 has a piston 44 at one end, and a tubing hanger 45 at the other. While the elements making up the piston 44 are clearly illustrated in FIG. 4, it will be appreciated that other types of piston structure might be employed so long as the piston provides sealing action within the cylindrical member 38.

The mandrel 43 on which the piston 44 is mounted has a cap 48 at the upper end thereof as viewed in the drawings. It includes a check valve 49 (see FIG. 3) therein. At the other end of the mandrel 43 there is a pipe threaded portion 52 that is adapted for being connected with an extension nipple 53, by means of a collar 54. The nipple 53 is designed to have a sufficient length to make the whole mandrel 43 long enough to extend through the shooting valve 33 after the mandrel is in place at the well head fixture. This is indicated in dashed lines in FIG. 1.

The tubing hanger 45 becomes a plug for sealing the well pressure when it is in place in the well head fixture 15, by having a plug means 57 attached to the tubing hanger 45 in any feasible manner, e.g. by employing a short threaded nipple 58.

While the plug means 57 might take various forms, it is preferably made up as illustrated in FIG. 3. It includes a so-called cork which is made up of a body 61 that has a spring biased check valve 62 at the top of the lower end thereof. The valve 62 has a valve guide, or shaft 65 that is surrounded by a helical spring 66 to bias the valve 62 into its closed position which is illustrated in FIG. 3. There is a valve seat 69 in the body 61, and it will be understood that there may be a sealing ring as indicated on the upper tapered face of the check valve 62. This seal is designed for contacting the valve seat 69. The upper portion of the body 61 is made up with exterior square threads 70 which are left hand threads, while on the inside of the top portion of body 61 there is a female threaded section 71 that is right hand threads. The top edge of the body 61 is notched as indicated by a reference number 74, so that a retrieving tool (not shown) may be employed for removing the so-called cork, i.e., body 61, at a later time as will be described more fully below.

The cylindrical member 38 (which acts as a pressure tight housing) includes a pair of fluid pressure connection ports 77 and 78 which are located near the two ends of the cylindrical body of the housing 38. It should be noted that there may be manifold piping with necessary valves therein, connected as schematically indicated in FIG. 1. The ports 77 and 78 are located near the ends of the cylindrical housing 38 so as to be always located above and below, respectively, the piston 44 whenever it is within the cylinder 38.

Figure 4:
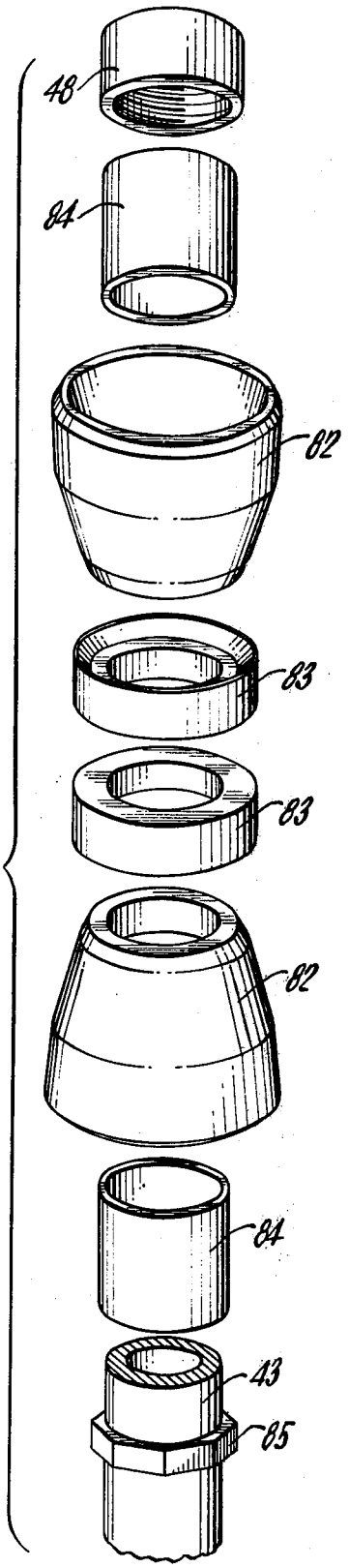
FIG. 4 is an exploded view in perspective, illustrating the elements which make up the piston of the tool according to the invention.

A cup-type piston structure for piston 44 is clearly illustrated in FIG. 4. It includes symmetrically situated pairs of resilient material cups 82, which are supported by shaped collars 83 at one end and sleeves 84 at the other. These elements all are designed for a sliding fit over the body of the mandrel 43. The cap 48 screws on at the upper end to hold the elements in place, while the lower sleeve 84 rests on a hexagonal collar 85 that is an integral part of the mandrel 43.

Method

Broadly, apparatus according to this invention may be used with a method of retrieving any well closure from the well head of a well which is under pressure, without killing the well. Such method comprises the following steps. First, the step of attaching a pressure tight means (e.g. the housing 38) containing a well head plug therein, on the other side of the said closure from the well head. With reference to FIG. 1, it will seem that this step may be carried out by first having inserted the mandrel 43 (with its attachments including the plug means 57 at the bottom end), into the cylindrical housing 38 prior to attaching the housing 38 above the well closure valve 33.

A next step is that of opening the said closure, i.e., valve 33, so as to permit passage of the plug therethrough into seating engagement with the well head. It will be observed that this step is accomplished by the opening of valve 33 and permitting the mandrel 43 to go through and have the tubing hanger 45 seat into the casing head fixture 15, so that the plug means 57 will close off the well within the casing 11. Some of the more detailed steps required to accomplish the foregoing will be described in greater detail below.

A final step of the broad method is that of securing the plug in place to contain the well pressure so that the well closure, i.e., valve 33, may thereafter be removed. This step involves the tightening of the set screws 25 in the well head fixture 15, above the top edge of the tubing hanger 45 so as to hold it securely in place and consequently act to plug the well head casing 11 by means of the plug 57 which incorporates the check valve in the body 61.

A more detailed method which involves the tool structure and auxiliary elements which have been described above, may be defined by the following steps. This method is one for removing a shooting valve, e.g. valve 33, from a well head (such as the well head fixture 15 illustrated) after the well has developed pressure. The well head fixture 15 includes a lateral port 16 therein which connects the interior of the casing 11 with the exterior of the fixture 15. The method steps may be described in the following manner.

A first step is that of assembling a mandrel having a piston at one end and a tubing hanger with a plug in said hanger, at the other end. It will be clear from the foregoing description of the apparatus that this would involve assembly of the mandrel 43 which has the piston 44 at one end and the tubing hanger 45 at the other end. The tubing hanger 45 has a plug 57 in the hanger. A qualification for the assembly steps is that relating to the mandrel length which must be long enough to extend through the shooting valve when the tubing hanger is seated in the casing fixture. It will be noted that this length is determined as necessary by the length of the extension nipple 53.

Another step is that of inserting the mandrel with its piston end first, into a cylindrical member having a closed end and a flange at the other end. The flange is adapted for being coupled to the shooting valve. It will be understood that this step of inserting the mandrel would ordinarily be carried out before the cylindrical housing member 38 is attached above the shooting valve 33. Thus, while the housing 38 is lying on its side the mandrel 43 may be inserted piston end first. Thereafter, the flange 40 on the housing 38 will be placed in alignment with the flange 35 on the shooting valve 33 followed by coupling thereto using the usual bolts, as indicated by the drawings. The latter coupling may be considered as the next step in the method. It couples the members 38 onto the shooting valve 33 with the mandrel 43 inside.

A next step is that of applying pressure beneath the piston in the cylindrical member in order to lift the mandrel up enough to clear said shooting valve. This step involves the connection of manifold means which may be made up of piping, as schematically indicated in FIG. 1. Thus, where there is piping 20 indicated as being connected to one side of the valve 21 (down near the well head fixture 15) there is in addition more piping 89, 90 and 91 along with valves 94, 95, 96 and 97 which will be connected up in the indicated manner. It will be understood that piping 20 will include a connection (not shown) up to the outside of valve 96 from the piping 89. After such piping connections have been made so as to provide the indicated manifold means, the step of applying pressure beneath the piston (as indicated) merely involves the opening of valve 21 and valve 96 plug valve 97, while maintaining valve 95 closed but opening valve 94. This will apply the pressure from the well head through the lateral port 16 and the pipe 19 to the manifold piping, so that pressure goes through valve 21, pipe 20, valve 96, piping 89, valve 97 and piping 91 into the lower end of the cylindrical member 38 through the port 78. This pressure will lift and support the entire mandrel 43 and its elements, in an upper position within the cylindrical housing 38.

Next, the shooting valve 33 will be opened, and this will make a clear passageway for the mandrel and also permit the well head pressure inside of the casing 11 to be transmitted through the valve 33 into the lower portion of the housing 38 underneath the piston 44 of the mandrel 43.

A next step is that of equalizing the pressure on both sides of the piston in order to allow the mandrel to fall until the hanger seats in the casing fixture. It will be clear that this equalization step may be carried out by closing the valve 94 and the valve 97, while opening the valve 95 so that the pressure in the piping manifold will be applied through the upper port 77 of the housing 38, above the piston 44. The mandrel 43 and piston 44 (plus the tubing hanger 45) will fall by gravity through the valve 33 which is now open, until the tubing hanger 45 seats in place within the corresponding chamber on the inside of the well head fixture 15.

A next step is fixing the hanger and plug in place at the top of the casing so as to contain the well pressure. This step involves the tightening of the set screws 25 above the top edge of the tubing hanger 45, so as to securely hold it in tight sealing relation with the interior of the well head fixture 15.

Thereafter, the next step involves releasing the equalization pressure existing above the piston 44, and the pressure beneath the piston, prior to the final step of removing the shooting valve. Such release is accomplished by opening the valve 94 as well as valves 95 and 97 while maintaining valve 96 closed.

Finally, the last step involves uncoupling and removing the shooting valve and the cylindrical housing member therewith. This final step may be accomplished by uncoupling the flange 34 of the shooting valve 33, from the flange 24 of the well head fixture 15, by removing the coupling bolts. Thereafter, the whole shooting valve and housing member together, may be vertically lifted off in the usual manner. It will be understood that this could be accomplished in two steps by first uncoupling the housing member 38 from the shooting valve 33 and lifting the housing off (in the manner indicated by the position of these elements in FIG. 2). Thereafter, the shooting valve 33 may be lifted off over the upper portion of the mandrel 43 and piston 44.

It will be clear that a final step would ordinarily be employed so as to disassemble the mandrel and remove all except the tubing hanger and plug.

Following the foregoing steps, it will usually be appropriate to render the well open for free production therefrom, by removing the plug from the tubing hanger. It will be understood by anyone skilled in the art that this step will necessitate the use of a tool (not shown) that may be inserted down through a lubricator (not shown) so that the well pressure is contained during the removal of the plug. Such retriever tool engages the notches 74 at the top of the plug body 61, and at the same time engages the extension of guide shaft 65 on the valve 62, so as to open the check valve against the spring pressure of spring 66. Then by rotating such tool additionally to the right (it being engaged in the inside threaded portion 71 of the body 61) the body 61 will rotate and cause the left-hand square threads 70 to unscrew the plug up out of the remainder of plug means 57 and so permit removal of the plug and check valve portion of the plug means.

It will be appreciated by anyone skilled in the art that the lubricator just mentioned above, is a standard item of equipment for oil well operations and consequently no illustration of this element is deemed necessary.

While particular embodiments of the invention, both apparatus and method have been described above in considerable detail in accordance with the applicable statutes, this is not to be taken as in any way limiting the invention but merely as being descriptive thereof.

We claim:

1. A retriever for use on a well having casing pressure and including a well head with valve means mounted thereon to contain said casing pressure, comprising in combination a mandrel having a piston adjacent to one end for supporting the weight thereof and having a plug for said well head at the other end, said mandrel being long enough to extend through said valve means when said plug is in place at said well head, a pressure tight housing comprising a cylinder adapted for cooperating with said piston and having an exit and adapted for receiving said mandrel therein with said plug facing said exit, said housing also having means for attaching said exit to said valve means on the side opposite to said well head, means associated with said housing for cooperating with said mandrel supporting means and for releasing said mandrel when said valve means is open whereby said plug will fall into place at said well head, and means for securing said plug against said casing pressure whereby said valve means may be removed without killing said well.

2. A retriever according to claim 1, wherein said exit attaching means comprises a flange.

3. A retriever according to claim 2, wherein said means associated with said housing comprises manifold means for applying pressure at the ends of said cylinder, and valve means for controlling said pressure.

4. A retriever according to claim 3, wherein said well head includes a casing fixture with a lateral port therein connecting the interior of said casing with the exterior thereof, said casing fixture being adapted for receiving a tubing hanger, said well head plug being integrally attached to said tubing hanger, and said manifold means also comprises means for connecting the exterior of said lateral port with the remainder of said manifold means.

5. A shooting valve retriever for use in removing a shooting valve or the like from a well head when the well has developed pressure, said well head having a casing fixture with a lateral port connecting the interior of said casing with the exterior of said fixture, comprising in combination an elongated cylindrical member having one end closed and having a flange on the other end adapted for being coupled to said shooting valve, a mandrel having a piston at one end and a tubing hanger at the other end, said piston being adapted to make a sealing fit with the inside of said cylindrical member, said tubing hanger being adapted to match said casing fixture, manifold means for connecting said lateral port with said cylindrical member for applying well pressure to support said mandrel in said member after said member has been coupled to said shooting valve, valve means for equalizing said well pressure on both sides of said piston to permit said mandrel to fall through said shooting valve when open and seat said tubing hanger in said casing fixture, and means for fixing said hanger in place to hold said well pressure, said tubing hanger having plug means for stopping flow of well fluid therethrough.

6. A retriever according to claim 5, wherein said plug means is removable from said tubing hanger.

7. A retriever according to claim 6, wherein said manifold means comprises piping, and said valve means comprises a plurality of valves in said piping.

8. Method of removing a shooting valve or blow-out preventer or the like from a well head after the well has developed pressure, said well head having a casing fixture with a lateral port therein connecting the interior of said casing with the exterior of said fixture, comprising the steps of assembling a mandrel having a piston at one end and a tubing hanger at the other end with a plug in said hanger, said mandrel being long enough to extend through said shooting valve when said tubing hanger is seated in said casing fixture, inserting said mandrel piston end first into a cylindrical member having a closed end and a flange at the other end adapted for being coupled to said shooting valve, coupling said cylindrical member onto said shooting valve with said mandrel inside, applying pressure beneath said piston in said cylindrical member to lift said mandrel up enough to clear said shooting valve, opening said shooting valve, equalizing the pressure on both sides of said piston in order to allow said mandrel to fall until said hanger seats in said casing fixture, fixing said hanger and plug in place in said casing fixture to contain said well pressure, releasing said equalization pressure and said pressure beneath said piston, and uncoupling and removing said shooting valve and cylindrical member together.

9. Method according to claim 8, also comprising the step of disassembling said mandrel to remove all except said tubing hanger and plug.

10. Method according to claim 9, further comprising the step of removing said plug including use of a lubricator.

* * * * *